United States Patent [19]

Seragnoli

[11] Patent Number: 4,519,405

[45] Date of Patent: May 28, 1985

[54] SPACER DEVICE FOR FILTER FITTING MACHINE

[75] Inventor: Enzo Seragnoli, Bologna, Italy

[73] Assignee: G.D. Societa per Azioni, Bologna, Italy

[21] Appl. No.: 398,544

[22] Filed: Jul. 15, 1982

[30] Foreign Application Priority Data

Aug. 7, 1981 [IT] Italy ..... 49073 A/81

[51] Int. Cl.[3] ..... A24C 5/32; A24C 5/35

[52] U.S. Cl. ..... 131/94

[58] Field of Search ..... 131/94, 95

[56] References Cited

U.S. PATENT DOCUMENTS 3,961,633 6/1976 Schubert ..... 131/94

FOREIGN PATENT DOCUMENTS 21362 5/1961 German Democratic Rep. ... 131/94

*Primary Examiner*—V. Millin

*Attorney, Agent, or Firm*—Marshall, O'Toole, Gerstein, Murray & O'Toole

[57] ABSTRACT

A spacer device for pairs of cigarette pieces in a filter fitting machine, the device being provided with a plurality of conveyors interposed between an input conveyor and an output conveyor and operable to transfer each pair of cigarette pieces from an axial seat formed on the input conveyor to an axial seat formed on the output conveyor; one cigarette piece of each pair of cigarette pieces being transferred directly from the input conveyor to the output conveyor and the other cigarette piece of each pair of cigarette pieces being transferred to the output roller via the said plurality of conveyors, of which one conveyor is a spacer conveyor operable to impart to the said other cigarette pieces an axial displacement in a direction opposite the facing end of the associated first cigarette piece.

9 Claims, 5 Drawing Figures

SPACER DEVICE FOR FILTER FITTING MACHINE

BACKGROUND OF THE INVENTION

The present invention relates to a spacer device for separating pairs of cigarettes in a filter fitting machine.

In filter fitting machines the technique normally adopted for obtaining filter cigarettes, starting from cigarette pieces consists in making said pieces advance in pairs along a conveyor on which the cigarette pieces of each pair are aligned with one another within a single recess. Each pair of cigarette pieces is then fed onto a conveyor serving as a separator or spacer on which the said two cigarette pieces are progressively separated from one another in an axial sense until there is defined between their facing ends a space which can receive a double filter from another conveyor. The ends of the double filter are then connected to the ends of the two cigarette pieces, thus forming a double cigarette which can be converted into two cigarettes simply by cutting the said double filter in half.

The axial separation of the cigarette pieces of each pair on the conveyor serving as a separator (generally comprising a roller) is obtained by means of retractors disposed centrally with respect to the said pairs cigarette pieces and acting simultaneously on the two pieces of each pair. Such roller has a constructional complexity and a structure which makes it extremely exposed to the infiltration of tobacco dust after lengthy operation, and in particular at the high production speeds of modern filter fitting machines.

This constitutes an obstacle to the correct operation of the spacer device.

Because of this complexity the unavoidable cleaning operations are particularly laborious.

SUMMARY OF THE INVENTION

The object of the present invention is that of providing a spacer device the constructional simplicity and structure of which both make it difficult for it to be subjected to infiltration of tobacco dust.

The said object is achieved by the present invention in that it relates to a spacer device for pairs of cigarette pieces in a filter fitting machine, the device including an input conveyor which can receive a succession of pairs of cigarette pieces, the cigarette pieces of each pair being disposed in axial alignment with one another and substantially in end-to-end contact within a respective conveyor seat which is movable transversely with respect to the axes of the cigarette pieces themselves, and being characterised by the fact that it further includes a conveyor chain for only a first cigarette piece of each said pair of pieces; the said conveyor chain including at least first and second conveyors which are substantially tangential to one another and at least the first of which is substantially tangential to an input conveyor for taking up from this latter each said first cigarette pieces at the tangential zone, and one of which conveyors is a spacer conveyor including translation means for imparting to each said first cigarette piece a predetermined axial displacement in a direction opposite the end of each said first cigarette piece in contact with an associated second cigarette piece on the said input conveyor.

BRIEF DESCRIPTION OF THE DRAWINGS

Further characteristics and advantages of the present invention will become apparent from the following description with reference to the attached drawings which illustrate various non limiting embodiments thereof, and in which:

FIGS. 1 and 3 schematically illustrate two further embodiments of the device of the present invention;

DETAILED DESCRIPTION OF THE INVENTION

Figure 1:
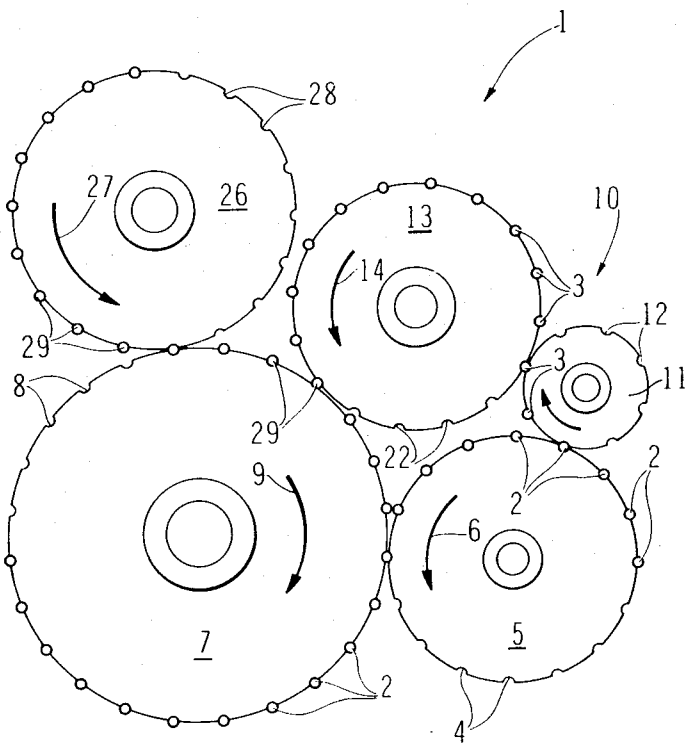
FIG. 1 schematically illustrates a first embodiment of a spacer device formed according to the principles of the present invention.

In FIG. 1 there is illustrated a spacer device 1 mounted on a filter fitting machine (not illustrated) and operable to axially separate cigarette pieces 2 and 3 disposed coaxially with respect to one another in a seat 4. Seat 4 is positioned axially, together with a plurality of similar axial seats 4, on the periphery of an input conveyor or roller 5 turnable in a counter-clockwise direction in FIG. 1 as indicated by an arrow 6. The roller 5 is disposed substantially tangentially with respect to an output conveyor or roller 7 which is also provided with a plurality of axial peripheral seats 8 which can each receive a pair of cigarette pieces 2 and 3. The roller 7 is rotatable in a clockwise direction in FIG. 1 as indicated by the arrow 9, with a peripheral velocity identical to that of the roller 5.

Adjacent the roller 5 there is disposed a conveyor chain 10 for a single row of cigarette pieces (in the example illustrated the pieces 3) including a deflector or intermediate roller 11 provided with peripheral axial seats 12. Seats 12 are adapted to each receive an associated cigarette piece 3 taken off normally by suction (from suction means not illustrated) from a corresponding seat 4 of the roller 5. The intermediate roller 11 is substantially tangential to the roller 5 along a generatrix located upstream, in the sense of rotation of the roller 5, from the point of contact of roller 5 with the output roller 7.

The conveyor chain 10 further includes a spacer conveyor or roller 13 which is rotatable in a direction indicated by an arrow 14 in the same direction as the arrow 6. The roller 13 is substantially tangential both to the intermediate roller 11, along a generatrix of roller 11 located downstream of the tangential generatrix of roller 11 with the input roller 5, and with the output roller 7, along a generatrix of this roller 7 disposed upstream of the generatrix of roller 7 tangential with the roller 5.

Figure 4:
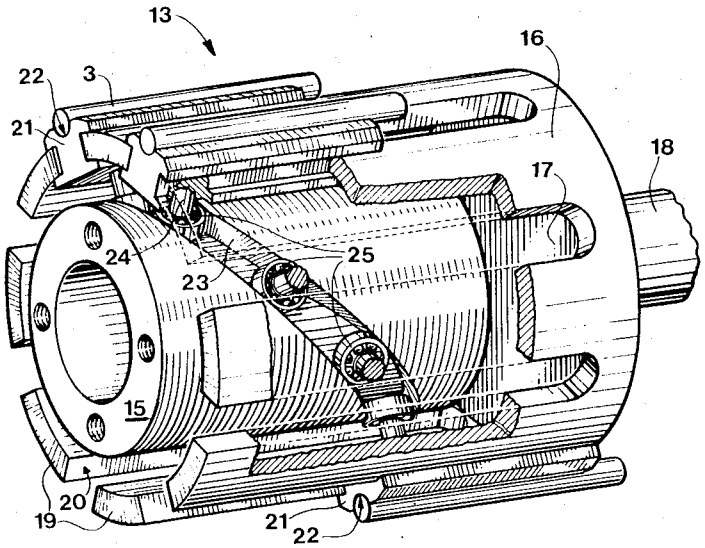
FIG. 4 is a perspective view of a detail of FIGS. 1 to 3.

As illustrated by way of example in FIG. 4 the spacer roller 13 includes an inner support drum 15 which is supported in fixed position by means, not illustrated, and is housed within a cage 16 substantially formed as a cup and including a cup bottom wall 17 facing an end wall of the drum 15 and rigidly connected to a drive shaft 18 which is operable to carry the cage 16 into rotation with respect to the drum 15, and a substantially cylindrical side wall disposed coaxially with respect to the drum 15 and defined by a plurality of axial arms 19 uniformly distributed about the drum 15. Each pair of adjacent arms 19 defines an axial slit 20 along which there is slidably mounted a slide 21. Slide 21 is provided on its surface opposite that facing the drum 15 with a groove defining a seat 22 capable of receiving and retaining a respective cigarette piece 3 by suction means not illustrated. The drum 15 has on its outer lateral surface a groove or track 23 lying substantially on an inclined plane with respect to the axis of the drum 15, and having a substantially eliptical form one vertex of which, nearest the wall 17, is disposed in proximity to the contact generatrix of the spacer roller 13 with the intermediate roller 11, and the other vertex of which is disposed close to the contact generatrix of the spacer roller 13 with the output roller 7.

From the end of each slide 21 opposite the wall 17 there extends inwardly an arm 24 carrying at its free end a rotatable roller 25 engaged within the track 23 and serving as a tappet for the associated slide 21. As illustrated in FIG. 1 a filter carrier roller or conveyor 26 is associated with the spacer device 1. Filter carrier roller 26 is rotatable with a peripheral velocity which is identical to that of the other rollers 5, 7 and 13 and in a rotational sense in the same direction as spacer roller 13 as indicated by an arrow 27. The roller 26 is disposed substantially tangentially with respect to the output roller 7 along a generatrix of roller 7 disposed upstream of the contact generatrix of roller 7 with the spacer roller 13. Roller 26 and is provided on its outer periphery with a plurality of axial grooves 28, each of which can receive a double filter 29, that is to say a filter constituted by a piece of filter material the length of which is twice that of a cigarette filter.

In use, two cigarette pieces 2 and 3 are supplied by a cigarette making machine (not illustrated) in axial or end-to-end arrangement to each seat 4 of the input roller 5 which, rotating in the direction indicated by the arrow 6, causes them to advance until they reach a position tangential with respect to the intermediate roller 11. Roller 11 has a length substantially equal to about half of the length of the roller 5 and is disposed with its seats 12 facing only the cigarette pieces 3 and not pieces 2. The pieces 3, once the said tangential position has been reached, are transferred to the seats 12 from the seats 4. The seats 4 thus remain holding only the cigarette pieces 2.

The cigarette pieces 3 are advanced by the intermediate roller 11, along an arc of a relatively smaller circle having an opposite curvature from that of the arc followed when they are carried by the roller 5, until they reach a point of tangency with the spacer roller 13. The spacer roller 13 has a length substantially twice that of the intermediate roller 11 and is positioned facing roller 11 in such a way as to permit the transfer of the cigarette pieces from the seats 12 to the seats 22. The spacer roller 13 then makes the cigarette pieces 3 advance until they are deposited in the seats 8, of the output roller 7, with each aligned with a respective cigarette piece 2 which, as opposed to the cigarette pieces 3, do not traverse the conveyor chain 10 but are directly transferred from the input roller 5 to the output roller 7 at the point where these are tangential to one another.

During their advancement within the seats 22 of the spacer roller 13 the cigarette pieces 3 are subjected, because of the inclination of the track 23, to a predetermined axial displacement in a direction away from the end of each cigarette piece 3 facing the associated cigarette piece 2 on the input roller 5. Consequently, when the cigarette pieces 3 reach the seats 8 of the output roller 7 they are axially displaced with respect to the cigarette pieces 2 disposed in the seats 8, and the space between the facing ends of each pair of cigarette pieces 2 and 3 is occupied by a double filter 29 supplied from the filter carrier roller 26 to the central portion or middle of each seat 8 before it is engaged by the associated cigarette pieces 3.

Figure 2:
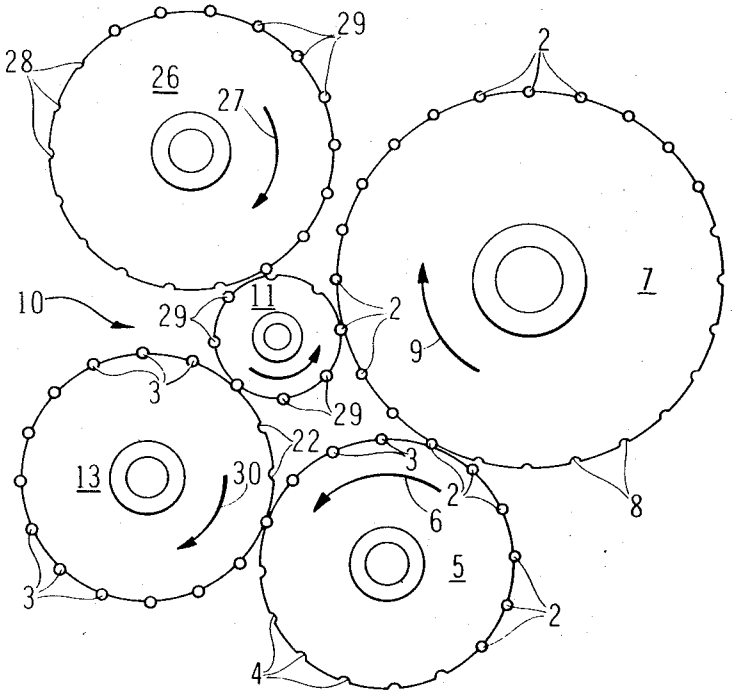

In the embodiment illustrated in FIG. 2, the positions of the intermediate roller 11 and the spacer roller 13 are inverted with respect to those of the embodiment illustrated in FIG. 1. Consequently the cigarette pieces 3 are directly transferred from the seats 4 of the input roller 5 to the seats 22 of the spacer roller 13 which turns in the opposite direction from the roller 5 as indicated by an arrow 30. In the case of the embodiment illustrated in FIG. 2, the intermediate roller 11 has the dual function of transferring the cigarette pieces 3 from the spacer roller 13 to the output roller 7, and of receiving the double filters 29 which are supplied to the intermediate roller 11 from the filter carrier roller 26 and are transferred onto the roller 7 together with the associated cigarette pieces 3.

Figure 3:
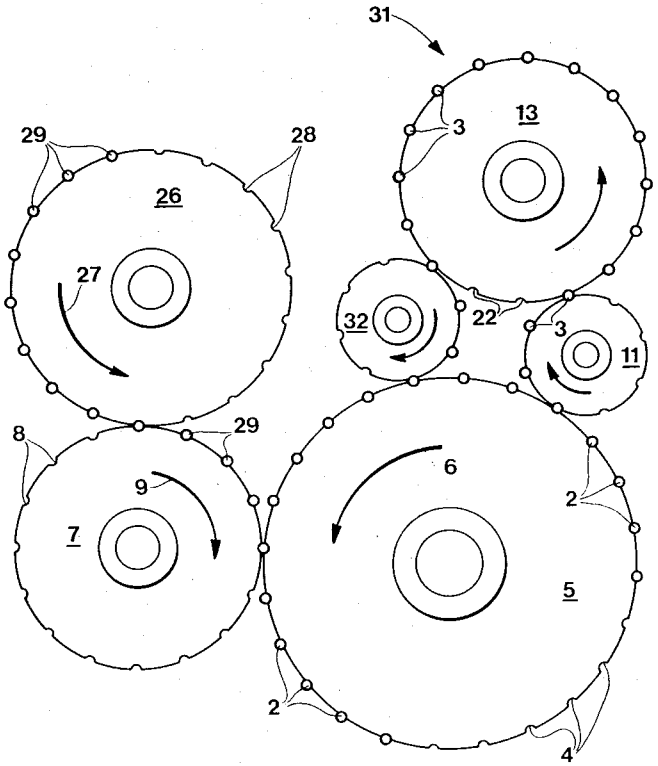

In the embodiment illustrated in FIG. 3 the conveyor chain 10 of FIG. 1 is replaced with a conveyor chain 31 extending from two separate points on the same input roller 5. The chain 31, like the chain 10, includes an intermediate roller 11 disposed tangentially to a point on the periphery of the input roller 5 and to a point on the periphery of the spacer roller 13. However, as compared to chain 10, in the chain 31 the roller 13 is not disposed tangentially to the output roller 7, but to a further deflector or intermediate roller 32, the purpose of which is to transfer the cigarette pieces 3 back onto the input roller 5 once these have been subjected to the axial displacement necessary to permit the insertion of the double filters 29.

Figure 5:
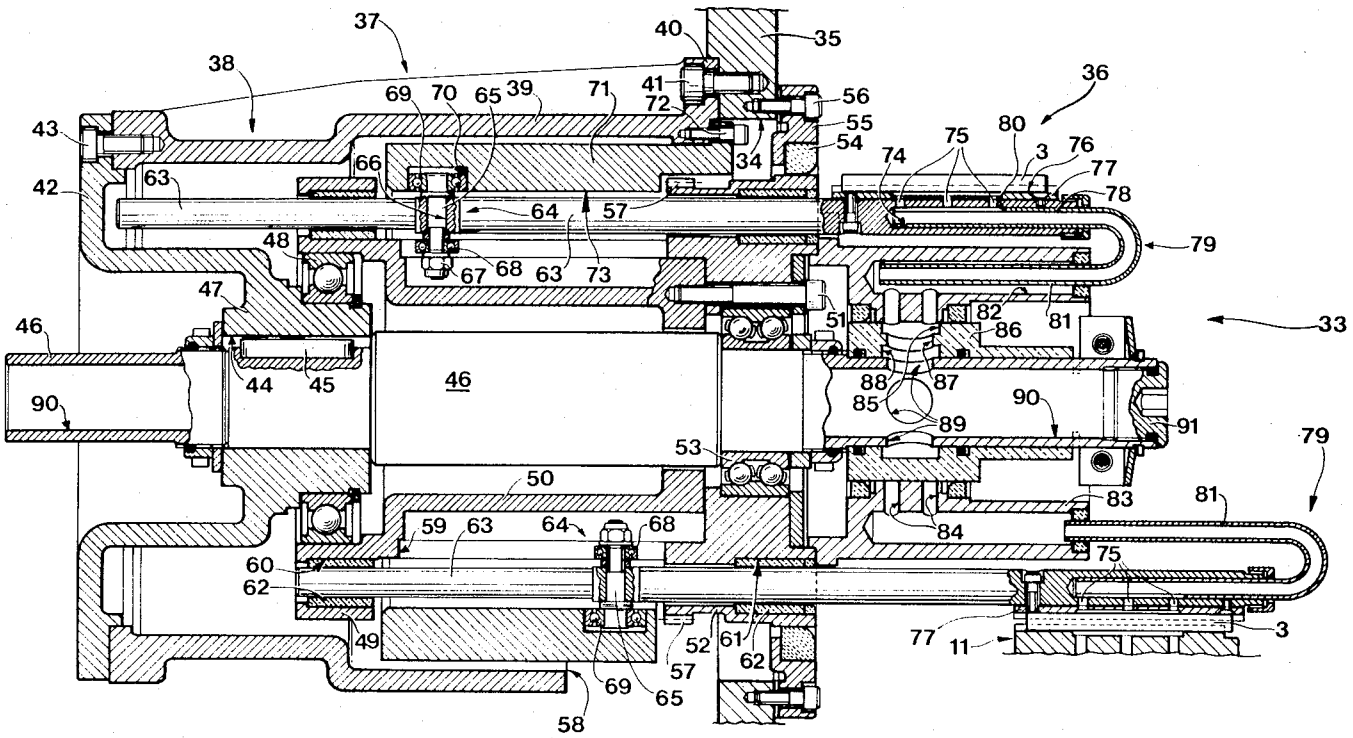
FIG. 5 illustrates in section a variant of the detail of FIG. 4.

The variant illustrated in FIG. 5 relates to a spacer roller 33 mounted through a hole 34 in a support wall 35 and including a support drum 36 for the cigarette pieces 3 disposed on one side of the wall 35, and a drive device 37 for the drum 36 disposed on the other side of the wall 35 and completely protected therefrom. As illustrated in FIG. 5 the drive device 37 includes an outer bell 38 having a substantially cylindrical lateral wall 39 and provided at one end with a flange 40 connected by screws 41 to the wall 35 through the hole 34, and by a bottom wall 42 connected to the other end of the wall 39 by screws 43. The wall 42 has a central axial through hole 44 through which is keyed, by means of a key 45, a hollow shaft 46 extending through the bell 38 and the hole 34 and projecting out from the wall 35. The hole 44 is formed through a bush 47 extending from the wall 42 to the interior of the bell 38 and supports, by means of an interposed radial bearing 48, an annular body 49 at one end of a cylindrical sleeve 50 coaxial with the shaft 46 and disposed within the bell 38.

At the end of the sleeve 50 opposite that carrying the annular body 49 there is connected, by means of screws 51, a second annular body 52 extending through the hole 34 and rotatably coupled to the shaft 46 by means of an interposed radial bearing 53. The outer surface of the annular body 52 is sealingly coupled, by the interposition of an annular seal 54, to a ring 55 rigidly connected to the outer surface of the wall 35 by screws 56, and is provided, within the bell 38, with an outer toothed ring 57 which constitutes a drive coupling for the drive device 37 and is coupled to another toothed ring (not illustrated) extending radially within the bell 38 through an aperture 58 formed in the side wall 39.

On the outer surface of the sleeve 50 there are formed axial grooves 59 closed at one end by the annular body 49 and at the other end by the annular body 52. Each of the grooves 59 has associated corresponding axial through holes 60 and 61, which are coaxial with one another, and extend first through the annular body 49 and second through the annular body 52. Each pair of coaxial holes 60 and 61 is engaged in a rotatable and axially slidable manner, by means of the interposition of bearings 62, by a cylindrical shaft 63 provided with a guide member 64 comprising a pin 65 mounted through a diametral hole 66 and carrying, fixed at one of its ends by means of a nut 67, a radial bearing 68 disposed within the associated groove 59, which serves as a sliding guide for the associated bearing 68. On the end of each pin 65 opposite that carrying the bearing 68 there is mounted a second bearing 69 which can roll within a track 70 formed on the inner cylindrical surface of a sleeve 71, one end of which is rigidly connected to one end of the bell 38 by means of a plurality of screws 72.

The track 70 is of substantially eliptical form and constitutes, together with the sleeve 71, a drum shape cam generally indicated 73 and operable to impart an axial reciprocating movement to each shaft 63 upon each complete revolution of the sleeve 50 with respect to the cam 73 between a retracted position illustrated in the upper part of FIG. 5 and an extended position illustrated in the lower part of FIG. 5. Each shaft 63 has, on its portion disposed outside the bell 38 and forming part of the drum 36, an axial blind hole 74 communicating, via a plurality of radial holes 75, with the bottom of an axial groove 76 formed on a small plate 77 connected to the shaft 63 and facing radially outwardly with respect to the shaft 46. Each groove 76 can receive a cigarette piece 3 and convey it in rotation about the shaft 46 when a driving couple is applied to the sleeve 50 through the toothed wheel 57.

Within each hole 74 there is fixed one arm 78 of a tube 79 which is bent into a U-shape, which communicates with the radial hole 75 through a slit 80 and has a second arm 81 bent parallel to the associated arm 78 and disposed between this latter and the shaft 46. Each arm 81 is slidably engaged, with an air tight seal, within a blind axial hole 82 of an annular distributor 83. This latter is rigidly connected to the sleeve 50 and has radial holes 84 which can put each hole 82 into communication with a groove 85 extending along a circumferential arc on the outer surface of an annular body 86 fitted onto the shaft 46 and coupled in a sealed rotatable manner to the inner surface of the distributor 83. The groove 85 communicates via a radial hole 87 formed through the annular body 86 with an annular groove 88 formed on the inner surface of the annular body 86 and in turn communicating, via a radial hole 89 formed in the shaft 46, with an internal axial duct 90 of this latter, closed at one end by a threaded plug 91 and connected at the other end to an air suction device not illustrated.

In use, rotation of the sleeve 50 about the shaft 46 involves corresponding axial reciprocating displacements of the shafts 63 which are guided in their axial displacement by the associated grooves 59 and are controlled axially by the track 70 of the cam 73 in such a way as to receive the cigarette pieces 3 in the extended position and to give them up in the retracted position. For this purpose the groove 85 is disposed in such a way as to interrupt the communication between the radial holes 75 and the suction device (not illustrated) connected to the shaft 46 at a determined point of the retracted position, to permit the shafts 63 to release the associated cigarette pieces 3 after having displaced them by a determined axial distance.

I claim:

1. In a cigarette filter fitting machine, a spacer device comprising an input conveyor for pairs of cigarette pieces, each said pair comprising first and second axially aligned cigarette pieces arranged on the input conveyor transversely of a direction of advancement of said input conveyor and in substantially end-to-end contact with one another; an output conveyor for said pairs of aligned cigarette pieces, said output conveyor being tangential to said input conveyor and having means to support first and second cigarette pieces at a predetermined distance from one another axially aligned in pairs; a conveyor chain means extending from an input position on said input conveyor to a portion of said output conveyor adjacent to a zone on said output conveyor tangent to the input conveyor, with the input position bring upstream of said tangency zone; said conveyor chain defining a portion of an advancement path of said first cigarette pieces only between said input and output conveyors and comprising at least a first and a second conveyor substantially tangential to one another; said first conveyor being tangential to said input conveyor, and one of said first and second conveyors being a cigarette piece spacer conveyor; and cigarette piece translation means on said spacer conveyor to axially displace said cigarette pieces a predetermined distance relative to the spacer conveyor itself.

2. A device as claimed in claim 1 wherein said conveyor chain extends between said input position on said inoput conveyor to an output position on said output conveyor.

3. A device according to claim 2, characterised by the fact that the said first conveyor is an intermediate conveyor (11) for taking said first cigarette pieces from the said input conveyor (5), and the said second conveyor is the said spacer conveyor (13).

4. A device according to claim 2, characterised by the fact that the said first conveyor is the spacer conveyor (13).

5. A device as claimed in claim 1 wherein said conveyor chain extends between said input position on said input conveyor to an output position on the same input conveyor with said output position being arranged upstream from said tangency zone.

6. A device according to claim 5, characterised by the fact that the said conveyor chain (10) includes a third conveyor (32) substantially tangential both to the said input conveyor (5) and to the said second conveyor.

7. In a cigarette filter fitting machine, a spacer device comprising an input roller for pairs of cigarette pieces, each said pair comprising first and second axially aligned cigarette pieces arranged on the input roller transversely of a direction of advancement of said input roller and in substantially end-to-end contact with one another; an output roller for said pairs of aligned cigarette pieces, said output roller being tangential to said input roller and having means to support first and second cigarette pieces at a predetermined distance from one another axially aligned in pairs; a conveyor chain roller means extending from an input position on said input roller to a portion of said output roller adjacent to a zone on said output roller tangent to the input roller, with the input position being upstream of said tangency zone; said conveyor chain roller means defining a portion of an advancement path of said first cigarette pieces only between said input and output rollers and comprising at least a first roller and a second roller substantially tangential to one another; said first roller being tangential to said input roller, and one of said first and second rollers being a cigarette piece spacer roller; and cigarette piece translation means on said spacer roller to axially displace said cigarette pieces a predetermined distance relative to the spacer roller itself.

8. A spacer device according to claim 7 in which the first roller is an intermediate roller, tangential to the input roller, which receives first cigarette pieces from the input roller; the second roller is a spacer roller, tangential to the intermediate roller, which receives first cigarette pieces from the intermediate roller; and the spacer roller is tangential to the output roller, which receives first cigarette pieces from the spacer roller and receives second cigarette pieces from the input roller.

9. A spacer device according to claim 7 in which the first roller is a spacer roller, tangential to the input roller, which receives first cigarette pieces from the input roller; the second roller is an intermediate roller, tangential to the spacer roller, which receives first cigarette pieces from the spacer roller; and the intermediate roller is tangential to the output roller, which receives first cigarette pieces from the intermediate roller and receives second cigarette pieces from the input roller.

* * * * *